United States Patent [19]

Jung

[11] Patent Number: 5,039,547

[45] Date of Patent: Aug. 13, 1991

[54] METHOD FOR COATING THE CATHODE OF AN ELECTRON GUN WITH A THERMIONIC EMISSIVE SUBSTANCE BY PLASMA SPRAYING

[75] Inventor: Jongin Jung, Suwon, Rep. of Korea

[73] Assignee: Samsung Electron Devices Co., Ltd., Rep. of Korea

[21] Appl. No.: 433,354

[22] Filed: Nov. 7, 1989

[51] Int. Cl.[5] ..... B05D 1/08; B05D 5/12

[52] U.S. Cl. ..... 427/34; 427/78; 427/77; 427/423; 427/425; 427/427; 427/424; 118/303; 118/320

[58] Field of Search ..... 427/34, 423, 425, 427, 427/424, 77, 78; 219/121.36; 118/303, 320

[56] References Cited

U.S. PATENT DOCUMENTS 4,596,718 6/1986 Gruner ..... 427/34

FOREIGN PATENT DOCUMENTS 58-46550 6/1983 Japan .

OTHER PUBLICATIONS

Yoshida et al., "High-Tc Superconducting Films of Bi-Pb-Sr-Ca-Cu Oxide Prepared by Plasma Spraying", Jpn. J. Appl. Phys. 28(4) Apr. 1989, L639-642.

Murphy et al., "Ceramic Electrocatalysts for the Oxygen Evolution Reaction II: Plasma Sprayed Perovskite Coatings", Journal of the Canadian Ceramic Society, vol. 54, 1985, pp. 14-20.

Kirkland et al., "Thermal Spraying Superconducting Oxide Coatings", Adv. Cer. Mat., vol. 2, No. 3B Special Issue, Jul. 1987, pp. 401-410.

*Primary Examiner*—Michael Lusignan
*Assistant Examiner*—Roy V. King
*Attorney, Agent, or Firm*—Christie, Parker & Hale

[57] ABSTRACT

There is disclosed a method for coating the cathode of an electron gun with a thermionic emissive substance comprising the steps of producing a plasma within a nozzle body, injecting nitrogen, hydrogen, helium or argon, or mixtures thereof into said nozzle body, and feeding a powder or sintered bodies of said thermionic emissive substance around the negative electrode of said plasma, whereby said thermionic emissive substance is sprayed and deposited on the metal cap of said cathode in an oxidized state under the heat and pressure of said plasma. The nozzle body oscillates around a pivot while a plurality of electron gun cathodes move on a curved carrier in front of the nozzle for depositing the emissive substance in a zig zag path across the plurality of cathodes.

4 Claims, 2 Drawing Sheets

METHOD FOR COATING THE CATHODE OF AN ELECTRON GUN WITH A THERMIONIC EMISSIVE SUBSTANCE BY PLASMA SPRAYING

BACKGROUND OF THE INVENTION

The present invention concerns a method for coating the cathode of an electron gun with a thermionic emissive substance and an apparatus therefor.

Generally, the cathode of an electron gun is coated with alkaline earth metal carbonate as the thermionic emissive substance. More specifically, the cathode is made of a nickel cap welded onto a sleeve. The upper surface of the nickel cap is etched by a weak acid, and coated with a slurry composed of barium carbonate (BaCO3), strontium carbonate (SrCO3) and calcium carbonate (CaCO3) which is added with organic solvent and a binder, and ball-milled.

In the above process, the carbonate layer coated on the cathode must be oxidized by heating at about 950° C. in order to dispose of additives such as the binder, because of which the cathode may be easily stripped of the coated layer, thereby increasing the fault ratio. Moreover, because the coated layer is adhered to the metal cap by the binder, the adhesive strength may not be improved, and pressurized air is employed to spray the coating substance, so that oil, water, etc. are introduced into the coated substance, thereby blackening the cathode or impairing the thermionic emission characteristic.

Besides, because the density of the coated layer may not be improved, the thickness of the layer must be increased, so that the thermal conduction to the outer part of the coated layer is slowed down and therefore, the ignition of the electron gun is also slowed down.

SUMMARY OF THE INVENTION

The object of the present invention is to obviate the drawbacks inherent to the slurry coating method of prior art.

According to the present invention, a method for coating the cathode of an electron gun with a thermionic emissive substance comprises the steps of producing a plasma between two electrodes by high voltage of direct current, injecting nitrogen, hydrogen, helium or argon, or their mixture around the plasma electrodes, and feeding a powder or sintered bodies obtained by firing barium carbonate, strontium carbonate and calcium carbonate at a temperature between 900°-1100° C. between the plasma electrodes, whereby the oxidized powder is accelerated by the plasma, and deposited densely on the metal cap of the cathode.

An apparatus suitable for the inventive method comprises a cylindrical nozzle body having an upper end and a lower outlet, a positive electrode of a plasma generator suspended at the center of said upper end within said nozzle body, a negative electrode of said plasma generator provided inside the outlet of said nozzle, a gas injection tube communicating into the space adjacent to the positive electrode of said plasma generator, and a tube for feeding said thermionic emissive substance into the space adjacent to the negative electrode of said plasma generator.

DETAILED DESCRIPTION OF THE INVENTION

The present invention will now be described more specifically with reference to the drawings attached only by way of example.

Figure 1:
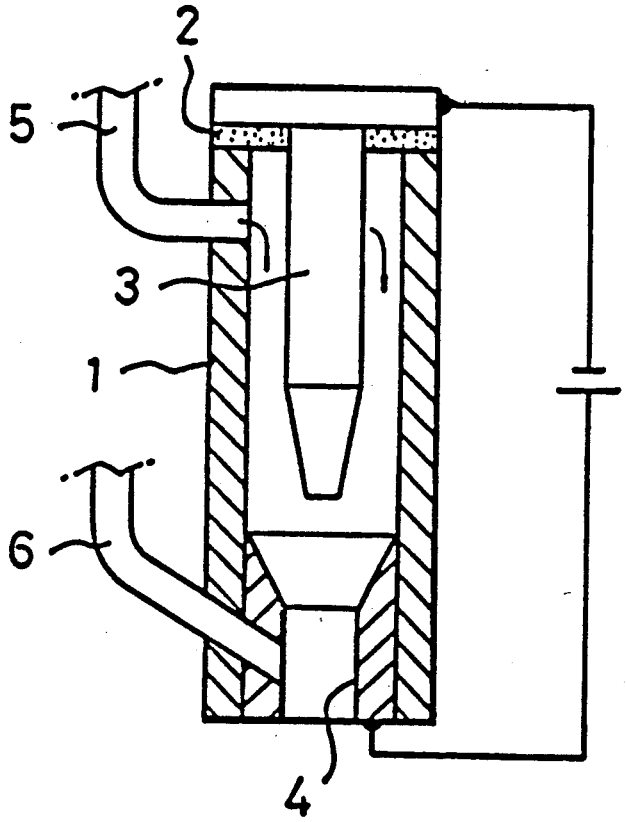
FIG. 1 illustrates schematically in longitudinal cross section an apparatus for embodying the present invention.

Referring to FIG. 1, at the center of the upper end of a cylindrical nozzle body 1 is suspended a positive electrode 3 of a plasma generator, and inside the outlet at the lower end of the nozzle body 1 is provided a negative electrode 4 of the plasma generator. Between the upper end plate and the side wall of the nozzle body is interposed an insulator 2.

Into the space adjacent to the positive electrode 3 communicates a gas injection tube 5, while into the space adjacent to the negative electrode 4 of the plasma generator communicates a tube 6 for feeding the thermionic emissive substance.

Figure 2:
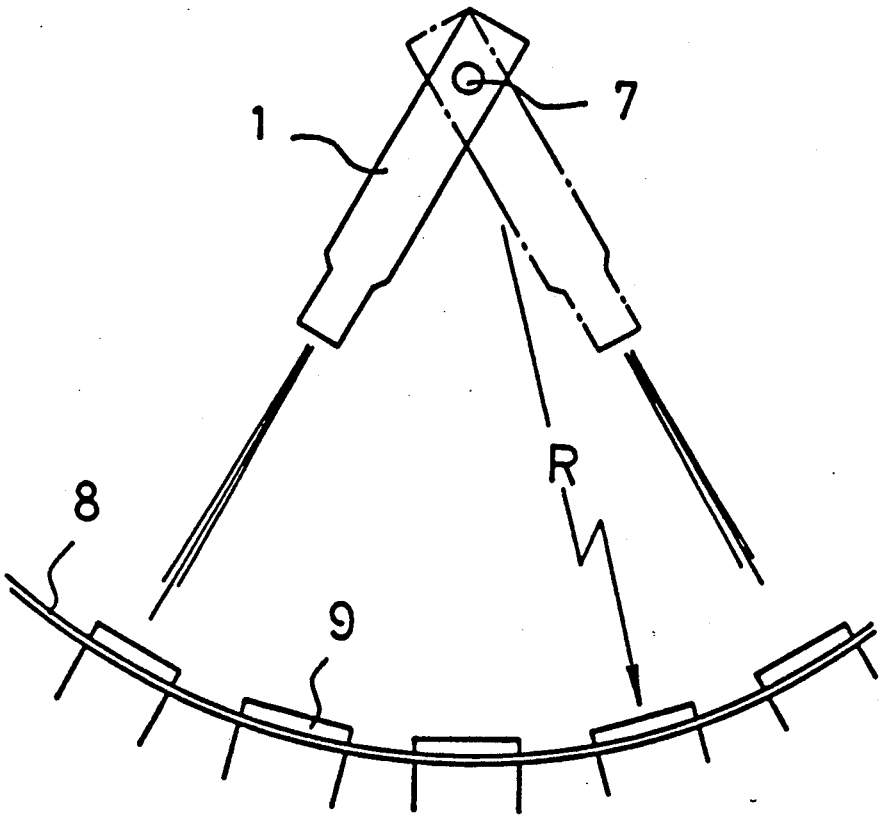
FIG. 2 is a schematic side view of the inventive coating process.

Referring to FIG. 2, the nozzle body 1 is suspended via a pivot 7 at the upper end thereof, so as to oscillate. Under the nozzle body 1 is arranged a cathode support 8 along the curve having the radius R from the pivot 7. The cathode support 8 moves at a constant speed according to the oscillation period of the nozzle body 1. On the cathode support 8 are orderly mounted a number of metal caps 9 welded onto sleeves.

A gas nitrogen, hydrogen, helium or argon, or a mixture thereof is injected through the gas injection tube 5 into the nozzle body 1, and a high voltage of direct current is applied to the two electrodes 3 and 4 to produce a plasma. Here, if the thermionic emissive substance is fed through the tube 6, the substance is oxidized by the plasma and accelerated to the speed of 300-400 m/sec, so that it is sprayed from the nozzle body 1 and deposited on the metal caps arranged in the cathode support 8.

Figure 3:
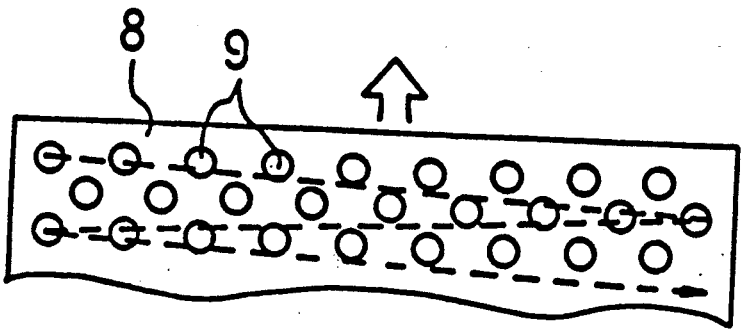
FIG. 3 is a plan view for showing schematically the traverse of the coating nozzle in the inventive process.

In this process, the nozzle body 1 oscillates around the pivot 7 and the cathode support 8 moves constantly according to the oscillation of the nozzle body, so that the deposition of the substance is performed in a zigzag course, as shown by the dotted arrow in FIG. 3.

The deposition thickness is determined by the oscillation speed of the nozzle body 1 and the moving speed of the cathode support 8. The metal cap 9 thus coated is subjected to the conventional heat treatment of 600°-1150° C.

The thermionic emissive substance is obtained by firing a wetted or dried mixture or barium carbonate, strontium carbonate and calcium carbonate in a platinum or high purity alumina vessel at 900°-1100° C. for 1-2 hours which decomposes the carbonates to alkaline earth metal oxides, and powdering or sintering the fired mixture into rod-type bodies.

Alternatively, to the watery mixture of sulfate, nitrate and chloride is added ammonium carbonate, oxalic acid or ammonia water solution to produce precipitates, which are collected, dried and fired at 500°-1200° C. to obtain the sintered bodies. In this case, if scandium chloride, scandium sulfide, or scandium nitride is further added to the above watery mixture to produce the precipitates, the current density and life of the cathode is improved.

As described above, since the thermionic emissive substance is deposited in an oxidized state on the cathode according to the present invention, it is not necessary to oxidize the coated layer after the deposition. Furthermore, since the coating substance is accelerated by pressure of the plasma, deposited densely on the metal cap, only 50 μm–1 mm of the coating thickness will cause the thermionic emission. Hence, the coating thickness may be reduced so that the thermal conduction of the heater is quickened, thereby hastening the ignition of the electron gun.

What is claimed is:

1. A method for coating the cathode of an electron gun with a thermionic emissive substance comprising the steps of:

producing a plasma within a nozzle body;

injecting a gas selected from the group consisting of nitrogen, hydrogen, helium, argon and/or mixtures thereof into said nozzle body; and feeding a powder of sintered bodies of a thermionic emissive substance comprising a mixed metal oxide of barium, strontium and calcium around the negative electrode for said plasma, whereby said thermionic emissive substance is sprayed and deposited on the metal cap of said cathode in an oxidized state under the heat and pressure of said plasma.

2. A method as recited in claim 1 comprising the steps of moving the nozzle body relative to the electron gun cathode and at the same time moving the cathode relative to the nozzle body in a direction perpendicular to movement of the nozzle body.

3. A method as recited in claim 1 comprising the steps of oscillating the nozzle body around a pivot and at the same time moving the electron gun cathode parallel to the pivot axis.

4. A method as recited in claim 3 comprising moving a plurality of electron gun cathodes parallel to the pivot axis along a path having a constant radius centered on the pivot axis.

* * * * *